US007753298B2

(12) United States Patent
Basten

(10) Patent No.: US 7,753,298 B2
(45) Date of Patent: Jul. 13, 2010

(54) ROTOR PROCESSOR

(75) Inventor: Aaron K. Basten, Solon, IA (US)

(73) Assignee: Vector Corporation, Marion, IA (US)

( * ) Notice: Subject to any disclaimer, the term of this patent is extended or adjusted under 35 U.S.C. 154(b) by 694 days.

(21) Appl. No.: 11/669,544

(22) Filed: Jan. 31, 2007

(65) Prior Publication Data

US 2008/0181050 A1 Jul. 31, 2008

(51) Int. Cl.
*B02C 23/00* (2006.01)

(52) U.S. Cl. ..... 241/62; 241/275

(58) Field of Classification Search ..... 241/57, 241/62, 275, 284
See application file for complete search history.

(56) References Cited

U.S. PATENT DOCUMENTS

| | | | | |
|---|---|---|---|---|
| 3,703,200 | A | 11/1972 | Palyi et al. | |
| 4,135,671 | A * | 1/1979 | Kohrs | 241/46.04 |
| 4,556,175 | A | 12/1985 | Motoyama | |
| 4,582,255 | A | 4/1986 | Won | |
| 4,623,098 | A | 11/1986 | Motoyama | |
| 5,033,405 | A | 7/1991 | Yamada et al. | |
| 5,038,709 | A | 8/1991 | Yamada et al. | |
| 5,096,744 | A | 3/1992 | Takei et al. | |
| 5,398,877 | A | 3/1995 | Xiangzhi | |
| 5,507,871 | A | 4/1996 | Morino et al. | |
| 5,856,719 | A | 1/1999 | DeArmas | |
| 5,904,951 | A | 5/1999 | Yamanaka et al. | |
| 5,961,291 | A | 10/1999 | Sakagami et al. | |
| 6,745,960 | B1 | 6/2004 | Myo et al. | |
| 6,955,309 | B2 | 10/2005 | Matthew et al. | |

FOREIGN PATENT DOCUMENTS

| | | | |
|---|---|---|---|
| GB | 2 069 863 | A | 9/1981 |

* cited by examiner

*Primary Examiner*—Faye Francis
(74) *Attorney, Agent, or Firm*—McKee, Voorhees & Sease, P.L.C.

(57) ABSTRACT

A rotor processor includes a stator chamber and a rotor mounted for rotation within the chamber. The rotor has a perimeter edge spaced closely to the interior wall of the chamber so as to define a slit or gap there between. The rotor is slidably mounted upon a rotor shaft, for movement between raised and lowered positions during operation of the processor, so as to automatically adjust the dimension of the slit, without operator intervention. As air flows from a plenum beneath the rotor, through the slit, and into the chamber, a pressure differential is created, which provides a lifting force to raise the rotor. The pressure drop is maintained relatively constant at a predetermined level after a lifting equilibrium force is achieved, regardless of the air flow volume.

13 Claims, 2 Drawing Sheets

ROTOR PROCESSOR

FIELD OF THE INVENTION

The present invention relates to a rotor processor for particulate material. More particularly, the processor includes a floating rotor to automatically adjust the peripheral gap between the rotor and stator chamber so as to maintain a substantially constant pressure differential above and below the rotor.

BACKGROUND OF THE INVENTION

There are many types of processors used to granulate, create spherical particles, and coat powders, seeds, pharmaceuticals, beads and other types of particulate material. For example, granulating methods include tumbling, agitating, extruding, disintigration, and fluidized beds. Some apparatus rotate the container, while other apparatus rotate a disk or rotor within a fixed container.

A rotor processor, also known as a centrifugal tumbling processor, has a narrow annular slit between the inner wall of the cylindrical container or chamber, and an outer peripheral edge of the rotatable rotor. The width of the slit is narrow so as to prevent particles in the chamber from falling through the slit. Air is forced upwardly through the slit as the rotor rotates within the chamber. The rotor forms a floor in the chamber upon which the powder or particles is supported. Rotation of the rotor and parts applies centrifugal force to the particles, which are thrown to the wall of the stator. Particles in the chamber are tumbled by the centrifugal force of the rotating rotor and the lifting force of the air passing upwardly through the slit.

The width of the slit governs the air velocity at the slit for a given air flow, which creates an upward draft that carries the particles upwardly. The upward movement of the particles continues, so long as the air velocity exceeds the transport velocity required to fluidize the particles. The air passes through the small gap with a relatively high velocity, and then expands into the larger volume of the stator chamber, thereby loosing velocity. As the particles loose their transport velocity, they fall back toward the center of the rotor and return to the rotor surface. The air slit velocity must exceed the transport velocity of the particles at all times, to prevent particles from passing downwardly through the slit.

Certain rotor processes require that a high slit velocity be achieved with a low volume of air flow, which necessitates that the slit be very narrow. Other processes, such as drying, require a large volume of air flow, which results in a large pressure drop across the slit. If the pressure drop is too large, then the static capacity of the air source, such as a blower, may be exceeded and the desired air flow is not achievable. In order to reduce the static pressure drop at larger air flows, it is necessary to increase the slit width or improve the inlet and exit geometry of the slit. In the prior art, the slit dimension has been modified using mechanical devices, such as levers or screws to raise and lower the rotor. In such prior art, movement of the rotor requires two steps: first, increasing the air flow potential, and second, adjusting the rotor slit, so as not to lose transport velocity of the particles in the chamber.

Therefore, a primary objective of the present invention is the provision of an improved rotor processor.

Another objective of the present invention is the provision of a rotor processor having a floating rotor for adjusting the slit dimensions.

A further objective of the present invention is the provision of a rotor processor wherein the slit dimension is automatically adjusted without human intervention.

Still another objective of the present invention is the provision of a rotor processor wherein the air pressure drop across the slit is maintained substantially constant as the slit dimension varies.

Yet another objective of the present invention is the provision of a rotor processor wherein the rotor is slidably mounted upon a rotor drive shaft for upward and downward movement along the shaft.

Another objective of the present invention is the provision of a rotor processor wherein the rotor is raised and lowered by air pressure.

Yet another objective of the present invention is the provision of an improved rotor processor having the ability to adjust the point at which a rotor lifting force exceeds a rotor resisting force.

Still another objective of the present invention is a method of processing particulate material in a rotor processor wherein the rotor is automatically raised and lowered in response to lifting and resisting forces.

Another objective of the present invention is the provision of an improved rotor processor which is efficient and effective in use.

These and other objectives will become apparent from the following description of the drawings and specification.

BRIEF SUMMARY OF THE INVENTION

The rotor processor of the present invention takes advantage of the increased pressure drop across the slit to automatically adjust the slit dimension. The rotor is free to lift a prescribed distance along the rotor drive shaft. The rotor lifting force is provided by the pressure differential between the air above and below the rotor slit. The resisting force derives from the weight of the rotor, the weight of the product on the rotor, and a variable fixed or adjustable mechanism, such as a spring. As the air flow increases through the slit, the pressure differential increases, thereby providing the lifting force to raise the rotor. As the rotor lifts, the slit width increases, such that the pressure drop maintains equilibrium with the lifting force required to move the rotor. The point at which the lifting force exceeds the resisting force can be adjusted by a variable force mechanism. The total pressure drop across the rotor will thus be maintained at a relatively constant and predetermined level, after the lifting equilibrium force is achieved, regardless of the air flow volume. When the air flow is decreased, the rotor moves downwardly. Thus, the fluidization transport velocity is maintained at all times during the process, without operator intervention to adjust the rotor.

DETAILED DESCRIPTION OF THE PREFERRED EMBODIMENT

Figure 1:
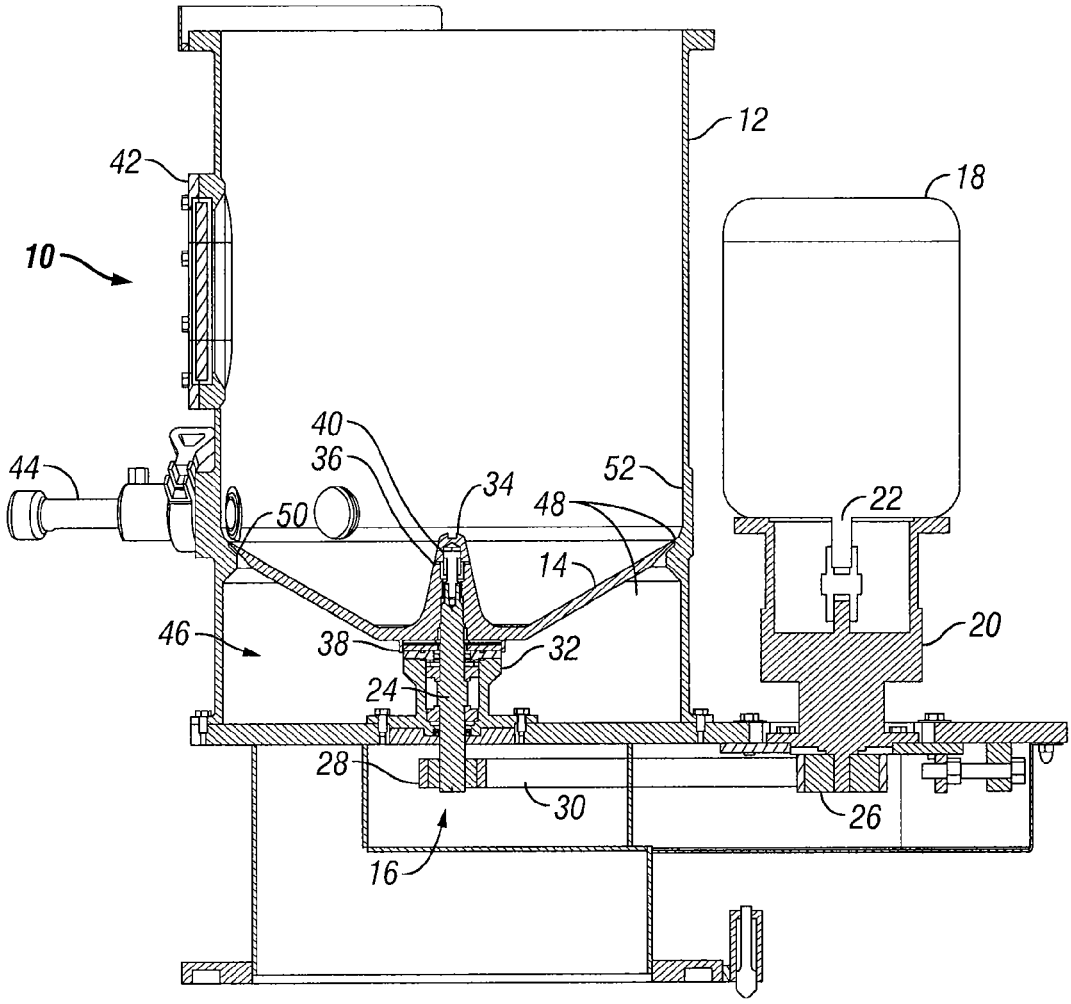
FIG. 1 is a sectional view of the rotor processor according to the present invention.

The rotor processor of the present invention is generally designated by the reference numeral 10 in the drawings. The processor 10 generally includes a container or stator chamber 12, a rotor 14 rotatably mounted within the chamber 12, and a drive train assembly 16 for rotating the rotor 14. The drive train assembly 16 includes a motor 18, with a reducer 20. The drive shaft 22 of the motor 18 is coupled to the rotor shaft 24 via sprockets 26, 28, and a belt or chain 30 trained about the sprockets 26, 28. The rotor shaft 24 is journaled within a bearing block 32 at the bottom of the chamber 12. Thus, actuation of the motor 18 rotates the drive shaft 22 and the coupled sprocket 26, which in turn rotates the sprocket 28, rotor shaft 24, and the rotor 14 via the belt or chain 30.

The rotor 14 is slidably mounted upon the rotor shaft 24 so as to be free to float upwardly and downwardly along the shaft 24 between lowered and raised positions, via a keyed, splined, or other mechanical drive joint. A cap 34 is provided at the top of the rotor 14. A seal 36 is provided between the cap 34 and the rotor 14. The bottom of the rotor 14 includes an annular member 38 which fits around the upper end of the bearing block 32 to function as a dust shield to keep dust and other debris out of the bearing block 32.

A force mechanism 40 is also provided between the rotor 14 and the rotor shaft 24. The mechanism 40 may be any type of a device, such as a spring, which provides reactive or resistive force to a lifting force, as described below. For example, the mechanism 40 may be a straight compression spring, a conical compression spring, a Belleville disk spring, an elastomeric flat disk spring, a curved disk spring, a wave disk spring, a finger disk spring, and the like. The mechanism 40 generally resides on the top of the rotor shaft 24 beneath the cap 34 to provide a resistive force to particulate material supported by the rotor 14. Alternatively, the mechanism 40 can be eliminated, and the weight of the rotor 14 increased slightly to duplicate the function and weight of a spring or the like.

The processor 10 also includes a window 42 built into the sidewall of the chamber 12, and a sampling port 44 to withdraw product samples from within the chamber during operation of the processor 10.

An air plenum 46 is provided beneath the rotor 14 in the bottom of the chamber 12. An air source provides pressurized air to the plenum 46. The air flows upwardly through the slit or gap 48 between the outer perimeter edge 50 of the rotor 14 and the interior wall surface 52 of the chamber 12. The gap or slit 48 provides running clearance between the rotor 12 and the chamber wall 52, and provides an air passage for flow of air there through from the plenum 46. The width of the slit or gap 48 governs the velocity of the air passing through the gap.

When the motor 18 is actuated to rotate the rotor 14, the centrifugal force of the rotor 14 is imparted to particles sitting on the rotor 14, which defines a floor for the chamber 12. The particles are thrown outwardly toward the chamber wall 52, wherein the air flowing through the gap 48 creates an upward draft that carries the particles upwardly, until the transport velocity required to fluidize the particles exceeds the air velocity of the upward draft. As the air leaves the confines of the gap 48, it expands into the larger volume of the chamber 12, thereby loosing its initial high velocity, such that the particles lose transport velocity and fall back toward the center of the rotor 14 onto the rotor surface. The air velocity at the slit 48 must exceed the transport velocity of the particles at all times during operation of the processor 10, in order to prevent particles from falling downwardly through the slit 48.

Figure 2:
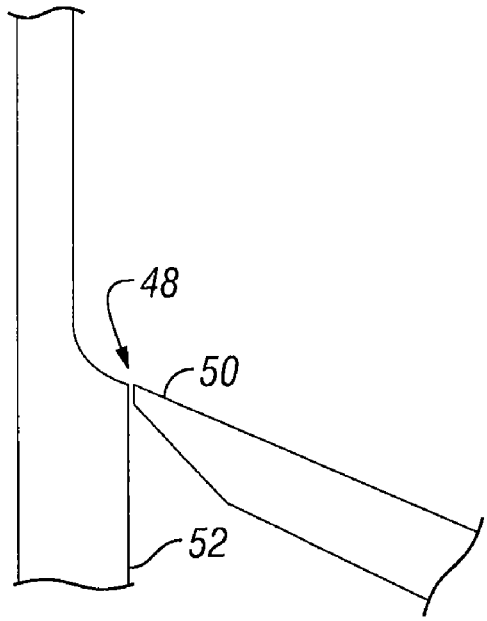
FIG. 2 is an enlarged view of the processor slit or gap with the rotor in the lowered position.
Figure 3:
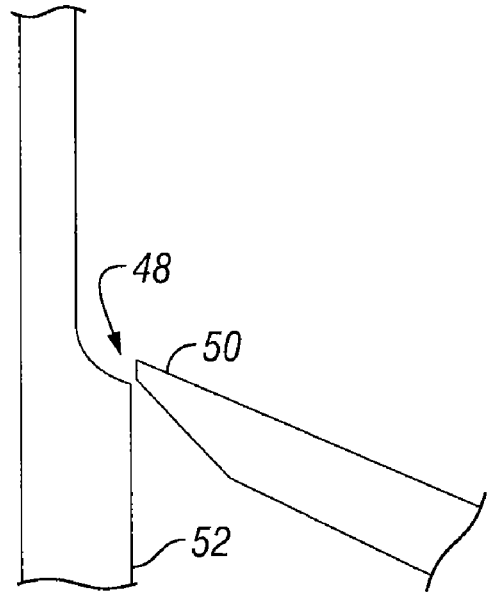
FIG. 3 is a view similar to FIG. 2 showing the rotor in the raised position with an enlarged gap.

The air in the plenum 46 also creates a lifting force on the rotor 14, such that the rotor 14 may slide upwardly along the rotor shaft 24 to a raised position. The lifting force is provided by the pressure differential between the air below and above the rotor gap 48. A counter resisting force is defined by the weight of the rotor, the weight of the particles on the rotor, and the force mechanism 40. As the air flow through the gap 48 increases, the pressure differential increases, thereby providing the lifting force to raise the rotor 14. As the rotor 14 moves towards the raised position, the width of the gap 48 increases, as seen in the comparison of the lowered position shown in FIG. 2 and the raised position shown in FIG. 3. Alternatively, the inlet and exit geometry of the gap may change as the rotor moves between the lowered and raised positions. This change in the gap width or geometry maintains equilibrium between the pressure drop and the lifting force. The point at which the lifting force exceeds the resisting force can be adjusted by the variable fixed or adjusting force mechanism 40. The resisting force through the use of a spring may be by a fixed design whereby the initial load, spring rate, spring length and final load are calculated to determine the design parameters. Other means, such as shims, threaded adjustment, variable interchangeable parts, (such as springs and spacers) may be used to vary the resisting force within a specific rotor design to optimize the rotor performance. The total pressure drop across the rotor 14 will therefore be maintained at a relatively constant and predetermined level, after the lifting equilibrium force is achieved, regardless of the air flow volume (within design limits). When the air flow is decreased, the rotor 14 automatically moves downwardly towards the lower or starting position, such that the fluidization transport velocity is maintained at all times during the process, without operator intervention to adjust the rotor 14.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A rotor processor for particulate material, comprising:

a stator chamber with an interior wall surface;

a rotor shaft extending into the chamber;

a rotor mounted on the rotor shaft for rotation within the stator chamber;

the rotor having a perimeter edge spaced closely to the interior wall surface of the chamber so as to define a slit there between;

a drive motor for rotating the rotor shaft and rotor;

the rotor being slidably mounted on the rotor shaft for movement between raised and lowered positions during operation of the processor so as to adjust the dimension of the slit;

an air source to direct air upwardly through the slit and to provide a lifting force to the rotor.

2. The rotor processor of claim 1 further comprising a force mechanism connected to the rotor to provide a resisting force to the lifting force.

3. The rotor processor of claim 2 wherein the force mechanism is a spring.

4. The rotor processor of claim 2 wherein the force mechanism is adjustable so as to control a point where the lifting force exceeds the resisting force.

5. The rotor processor of claim 1 wherein the slit creates an air pressure differential above and below the rotor when air flows through the slit, with the differential increasing as the air flow increases so as to lift the rotor.

6. The rotor processor of claim 5 wherein the slit dimension increases as the rotor lifts and decreases as the rotor falls, thereby maintaining a substantially constant pressure drop across the rotor as the rotor rises and falls.

7. The rotor processor of claim 1 wherein the rotor shaft and rotor have mating surfaces to provide a rotating connection there between and to allow vertical sliding movement of the rotor relative to the rotor shaft.

8. A rotor processor for particulate material, comprising:

a chamber for receiving the particulate material;

a rotor rotatably mounted in the chamber so as to define the floor of the chamber;

the chamber having a sidewall and the rotor having an outer edge;

a gap between the chamber sidewall and the rotor edge;

an air plenum beneath the rotor;

an air source to direct air into the plenum to create a lifting force on the rotor so as to move the rotor upwardly and downwardly.

9. The rotor processor of claim 8 wherein the gap has a dimension which increases as the rotor moves upwardly.

10. The rotor processor of claim 8 wherein the air source and the gap create a pressure drop above the rotor, and the drop remains substantially constant as the rotor moves upwardly and downwardly.

11. The rotor processor of claim 8 further comprising a force mechanism connected to the rotor to provide a resisting force to the lifting force.

12. The rotor processor of claim 11 wherein the force mechanism is adjustable so as to control a point where the lifting force exceeds the resisting force.

13. The rotor processor of claim 8 further comprising a motor for rotating the rotor.

* * * * *